US007245071B2

(12) United States Patent
Kamiguchi

(10) Patent No.: US 7,245,071 B2
(45) Date of Patent: Jul. 17, 2007

(54) IMAGE DISPLAY APPARATUS AND MANUFACTURING METHOD THEREOF

(75) Inventor: Kinya Kamiguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 212 days.

(21) Appl. No.: 11/101,514

(22) Filed: Apr. 8, 2005

(65) Prior Publication Data

US 2005/0225229 A1 Oct. 13, 2005

(30) Foreign Application Priority Data

Apr. 9, 2004 (JP) ..... 2004-115239

(51) Int. Cl.
*H01J 1/62* (2006.01)

(52) U.S. Cl. ..... 313/495; 313/496

(58) Field of Classification Search ..... 313/495, 313/496, 477 R, 631, 491, 493, 634
See application file for complete search history.

(56) References Cited

U.S. PATENT DOCUMENTS

| | | | | |
|---|---|---|---|---|
| 6,885,156 | B2 | 4/2005 | Tajima et al. | 315/169.3 |
| 7,101,244 | B2 | 9/2006 | Kamiguchi | 445/24 |
| 2003/0025443 | A1 | 2/2003 | Kamiguchi | 313/495 |
| 2003/0085651 | A1* | 5/2003 | Takahashi | 313/496 |
| 2006/0217024 | A1 | 9/2006 | Kamiguchi | 445/25 |

FOREIGN PATENT DOCUMENTS

| | | |
|---|---|---|
| JP | 2000-208031 | 7/2000 |
| JP | 2002-182585 | 6/2002 |
| JP | 2003-92075 | 3/2003 |
| JP | 2004-111376 | 4/2004 |

* cited by examiner

*Primary Examiner*—Vip Patel
(74) *Attorney, Agent, or Firm*—Fitzpatrick, Cella, Harper & Scinto

(57) ABSTRACT

An image display apparatus is composed of a substrate on which an electrode receiving the supply of a power source is formed. By providing an electroconductive member which adheres to the electrode through a hole and seals the hole, the formation of a hermetic lead-in terminal is made to be easy.

11 Claims, 11 Drawing Sheets

IMAGE DISPLAY APPARATUS AND MANUFACTURING METHOD THEREOF

BACKGROUND OF THE INVENTION

1. Field of the Invention

The present invention relates to an image display apparatus used for displaying characters and images, such as a display of a television receiver or a computer, and a message board, and a manufacturing method thereof.

2. Related Background Art

As an image display apparatus which has been generally spread widely, a color cathode ray tube (CRT) can be cited. Because the driving principle of the color CRT is that electron beams from the cathode thereof are deflected to make phosphors on the screen thereof emit light, the color CRT needs a depth according to the screen size thereof. Because the depth becomes long as the screen becomes large, the color CRT has problems of the expansion of the setting space thereof and of the increase of the weight thereof. Consequently, a thin-shaped flat type image display apparatus capable of being made to be light is strongly desired.

As the flat type image display apparatus, there are ones using plasma discharge, using a liquid crystal device, and using a vacuum fluorescent display. As the flat type image display apparatus attracting attention owing to its high picture quality and its low power consumption, a displaying apparatus using electron-emitting devices can be cited. The displaying apparatus using the electron-emitting devices is a displaying apparatus using a phenomenon of causing luminescence by the collision of electrons emitted in the inside of a vacuum chamber to a phosphor, to which a high voltage is applied. Accordingly, it is necessary to perform hermetic sealing of a voltage supplying path in the vacuum chamber. Japanese Patent Application Laid-Open No. 2003-92075 discloses concrete means of the hermetic sealing.

The configuration of the voltage supplying path to the phosphor disclosed in the Japanese Patent Application Laid-Open No. 2003-92075 is schematically shown in FIG. 11. In FIG. 11, reference numeral 100 denotes a leading wire, reference numeral 101 denotes a lead-in wire, reference numeral 102 denotes an insulating member, reference numeral 103 denotes a hermetic lead-in terminal, reference numeral 104 denotes frit glass, reference numeral 105 denotes a stand-alone wire, reference numeral 106 denotes a pressure structure, reference numeral 110 denotes a face plate, reference numeral 111 denotes a rear plate, reference numeral 112 denotes an electron source area, reference numeral 114 denotes an outer frame, and reference numeral 120 denotes an image-forming member.

In the configuration of FIG. 11, a hermetic container is formed by sealing the face plate 110, the rear plate 111 and the outer frame 114 with the frit glass 104. A voltage is applied to the leading wire 100 lead from the image-forming member 120 provided with the phosphor through the lead-in wire 101 lead-in from the outside. The lead-in wire 101 is configured as the hermetic lead-in terminal 103, in which the insulating member 102 is disposed around the lead-in wire 101. The hermetic lead-in terminal 103 adheres to a through-hole formed in the rear plate 111 with the frit glass 104, and thereby the hermetic sealing of the hermetic lead-in terminal 103 is performed.

However, because the calcination temperature of the frit glass is 350° C. or more, which is very high, in the above-mentioned method, in which the hermetic lead-in terminal 103 adheres with the frit glass, the process cost of the method is high, and the high process cost is the primary factor of raising the cost of an article. Moreover, because the frit glass contains lead, the frit glass has a problem on environmental health.

SUMMARY OF THE INVENTION

It is an object of the present invention to provide an image display apparatus equipped with a hermetic container including a voltage applying path having good airtightness and being capable of applying a voltage surely from the outside to an electrode provided in the inside of the hermetic container.

Moreover, it is another object of the present invention to provide an image display apparatus including a voltage applying path capable of obtaining good airtightness without necessitating an adhesion process at a high temperature and without producing any environmental problems.

The present invention is an image display apparatus equipped with a hermetic container, which includes a first substrate, a second substrate disposed to be opposed to the first substrate, and an outer frame disposed between both of the substrates, and an electrode disposed on the first substrate in the hermetic container, including an electroconductive member sealing a hole formed in the second substrate, and adhering to the electrode to form a voltage applying path to the electrode.

In an example, the image display apparatus further includes a member enclosing the electroconductive member at a gap between the first substrate and the second substrate, the member having a melting point higher than that of the electroconductive member.

In an example, the melting point of the electroconductive member is 350° C. or less.

In an example, the electroconductive member is an alloy containing at least one selected from the group consisting of In, Li, Bi and Sn.

In an example, an image display apparatus further includes an electron source disposed on the second substrate, and a phosphor disposed on the first substrate in the hermetic container, wherein the electrode is one for accelerating electrons emitted from the electron source.

Moreover, the present invention is a manufacturing method of an image display apparatus equipped with a hermetic container, which includes a first substrate, a second substrate disposed to be opposed to the first substrate, and an outer frame disposed between both of the substrates, and an electrode disposed on the first substrate in the hermetic container, including the steps of: disposing an electroconductive sealing member on the second substrate including a hole formed therein in order to cover the hole; disposing the first substrate provided with the electrode so that the electrode and the electroconductive sealing member may be opposed to each other; and heating the electroconductive sealing member to perform adhesion of the sealing member to the electrode and sealing of the hole with the sealing member.

In an example, the electroconductive sealing member disposed on the second substrate includes a member around the electroconductive sealing member, the member having a melting point higher than that of the electroconductive sealing member.

In an example, the melting point of the electroconductive sealing member is 350° C. or less.

In an example, the electroconductive member is an alloy containing at least one selected from the group consisting of In, Li, Bi and Sn.

In an example, an image display apparatus further includes an electron source disposed on the second substrate, and a phosphor disposed on the first substrate in the hermetic container, wherein the electrode is one for accelerating electrons emitted from the electron source.

DETAILED DESCRIPTION OF THE PREFERRED EMBODIMENTS

A first aspect of the present invention is an image display apparatus equipped with a hermetic container, which includes a first substrate, a second substrate disposed to be opposed to the first substrate, and an outer frame disposed between both of the substrates, and an electrode disposed on the first substrate in the hermetic container, including an electroconductive member sealing a hole formed in the second substrate, and adhering to the electrode to form a voltage applying path to the electrode.

A second aspect of the present invention is a manufacturing method of an image display apparatus equipped with a hermetic container, which includes a first substrate, a second substrate disposed to be opposed to the first substrate, and an outer frame disposed between both of the substrates, and an electrode disposed on the first substrate in the hermetic container, including the steps of: disposing an electroconductive sealing member on the second substrate including a hole formed therein in order to cover the hole; disposing the first substrate provided with the electrode so that the electrode and the electroconductive sealing member may be opposed to each other; and heating the electroconductive sealing member to perform adhesion of the sealing member to the electrode and sealing of the hole with the sealing member.

The voltage applying path according to the present invention is high in hermetic reliability and excellent in the reliability of electrical connection with an electrode.

Moreover, the voltage applying path according to the present invention can use an electroconductive member having a low melting point, and no high temperature processes are needed. Consequently, the voltage applying path can be implemented at a low price. Moreover, because the voltage applying path does not use any frit glass, it is excellent also in environmental health. Accordingly, by adopting the voltage applying path according to the present invention, it is possible to provide a highly reliable image display apparatus at a lower price.

In the following, the present invention will be described by exemplifying embodiments.

Figure 1:
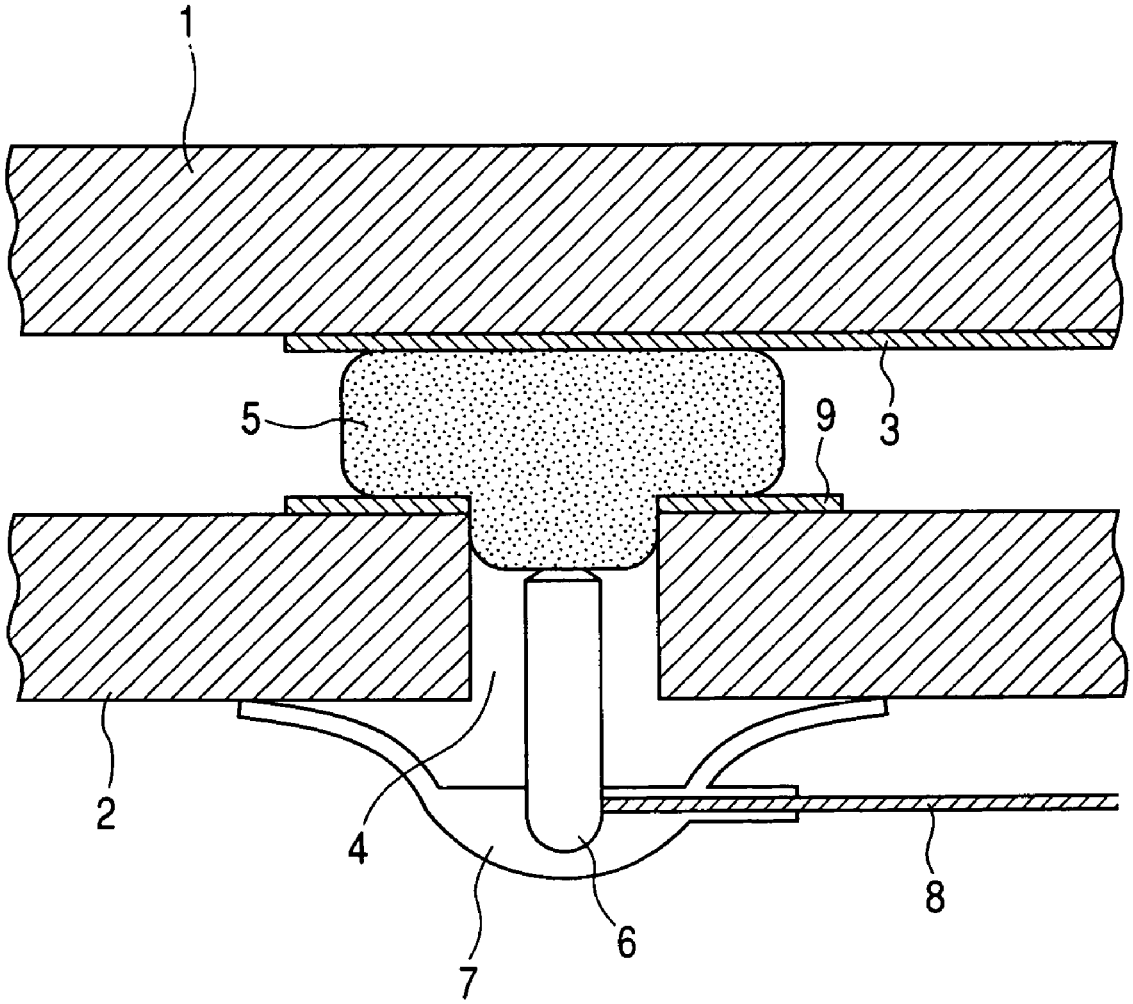
FIG. 1 is a schematic sectional view showing an embodiment of a voltage applying structure of the present invention.

FIG. 1 is a view schematically showing the configuration of a cross section of a voltage applying path of an embodiment of the image display apparatus of the present invention. In the drawing, reference numeral 1 denotes a first substrate, reference numeral 2 denotes a second substrate, reference numeral 3 denotes an electrode (a positive electrode wire in the present embodiment), reference numeral 4 denotes a hole, reference numeral 5 denotes an electroconductive member (a metal having a low melting point in the present embodiment), reference numeral 6 denotes an electroconductive part, reference numeral 7 denotes an insulating cover, reference numeral 8 denotes a voltage supply cable, and reference numeral 9 denotes an under electrode.

In FIG. 1, a positive electrode (not shown) connected to the electrode 3 is formed on the inner surface of the first substrate 1. Incidentally, because an electron source including electron-emitting devices are normally formed on the second substrate 2, a negative electrode or a pair of device electrodes to each device is formed on the second substrate 2. By performing the seal-bonding of the first substrate 1 and the second substrate 2 with the outer frame (not shown) put between them with a sealing member (not shown), a hermetic chamber is formed. As the first substrate 1 and the second substrate 2, a glass substrate is usually used.

The voltage applying path according to the present invention is formed between the positive electrode (not shown) connected to the electrode 3 in the inside of the hermetic container and the outside of the hermetic container by sealing the hole 4 formed in the second substrate 2 with the electroconductive member such as the low melting point metal 5, and by making the electroconductive member adhere to the electrode 3 formed on the first substrate 1.

In the voltage applying path in FIG. 1, a voltage applied to the voltage supply cable 8 is applied to the low melting point metal 5 as the electroconductive member through the electroconductive part 6. The voltage applied to the low melting point metal 5 is applied to the positive electrode (not shown) through the electrode 3. The conduction between the electroconductive part 6 and the voltage supply cable 8 is secured by a caulking structure. Moreover, the contact and the conduction between the electroconductive part 6 and the low melting point metal 5 is secured by pressing the electroconductive part 6 against the low melting point metal 5 side with the insulating cover 7. The low melting point metal 5 as the electroconductive member and the electrode 3 form a metallic bond by applying a temperature to them at the time of production, which will be described later, and thereby the conduction between them is secured. As long as a metal having a melting point at 350° C. or less may be used as the material of the low melting point metal 5. For example, alloys such as In, Li, Bi and Sn are preferably used. The electrode 3 and the under electrode 9 are electroconductive films. For example, they can be made by printing Ag paste and calcinating it.

Next, a manufacturing process of the voltage applying path of FIG. 1 is described along FIGS. 2A, 2B, 2C and 2D. In the drawings, reference numeral 10 denotes a head for energization heating. Incidentally, the process is performed in a vacuum atmosphere.

The low melting point metal 5 as the electroconductive sealing member is disposed in order to cover the hole 4 in the second substrate 2, on which the under electrode 9 has been formed.

From the opposite side of the hole 4 covered by the low melting point metal 5, the head for energization heating 10 is inserted, and is contacted with the low melting point metal 5. Then, a current is flown to melt the low melting point metal 5 (FIG. 2B).

When the low melting point metal 5 has been completely melted, the first substrate 1, on which the electrode 3 has been formed, is made to descend, and the melted low melting point metal 5 and the electrode 3 are made to be contacted with each other. Then, they are held for 10 minutes or more in that contacted state (FIG. 2C).

Figure 2A:
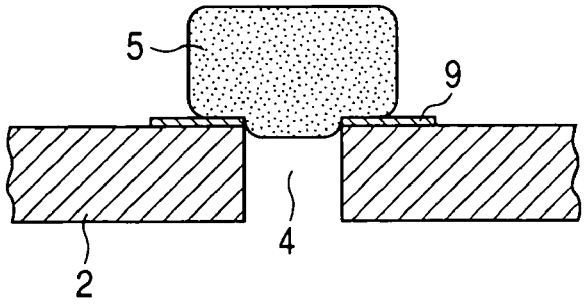
FIGS. 2A, 2B, 2C and 2D are process drawings of manufacturing the voltage applying structure of FIG. 1.
Figure 2B:
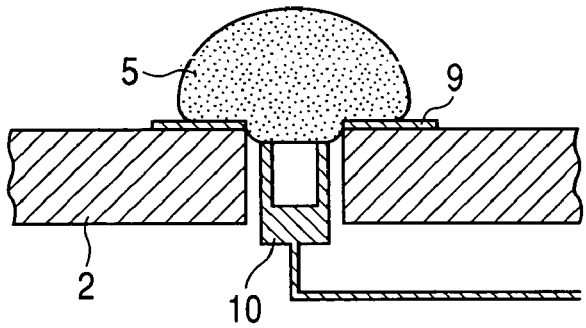
Figure 2C:
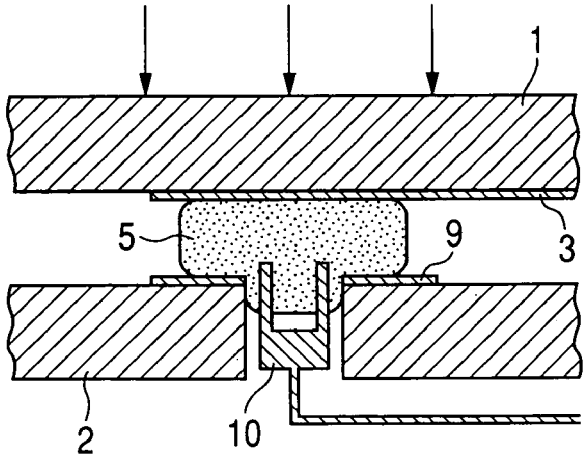
Figure 2D:
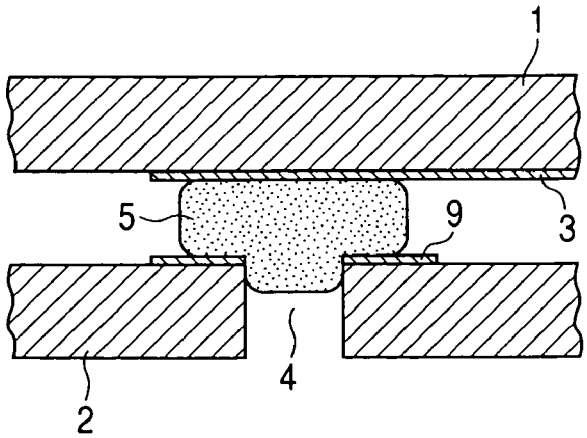

The head for energization heating 10 is retracted from the hole 4, and the sealing of the hole 4 by the electroconductive sealing member 5 and the adhesion of the sealing member 5 and the electrode 3 to each other are performed through natural heat dissipation by radiation (FIG. 2D).

Moreover, after the manufacturing by the above process, mounting for applying a voltage from the outside is performed. The mounting is to attach the insulating cover 7, the electroconductive part 6 and the voltage supply cable 8 to the substrates 2 in the state of FIG. 1. The electroconductive part 6 and the voltage supply cable 8 which have adhered to each other by the caulking structure or soldering are previously inserted and fixed to the insulating cover 7. Then, the insulating cover 7 is fixed in the state in which the electroconductive part 6 is contacted with the low melting point metal 5. As the fixing means, as long as means enables the securing of the conduction between them, such means may be adoptable. The method shown in FIG. 1 is one using the sticking force of the sucker type insulating cover 7.

FIGS. 3, 5, 7 and 9 show schematic sectional views of other embodiments of the voltage applying path according to the present invention. In the drawings, reference numeral 31 denotes a control member, reference numeral 32 denotes a fixing nut, reference numeral 33 denotes an adhesive, reference numeral 71 denotes a potting agent, reference numeral 91 denotes a metal part, and reference numeral 92 denotes a hook. The same members as those in FIG. 1 are denoted by the same reference numerals as those in FIG. 1.

Figure 3:
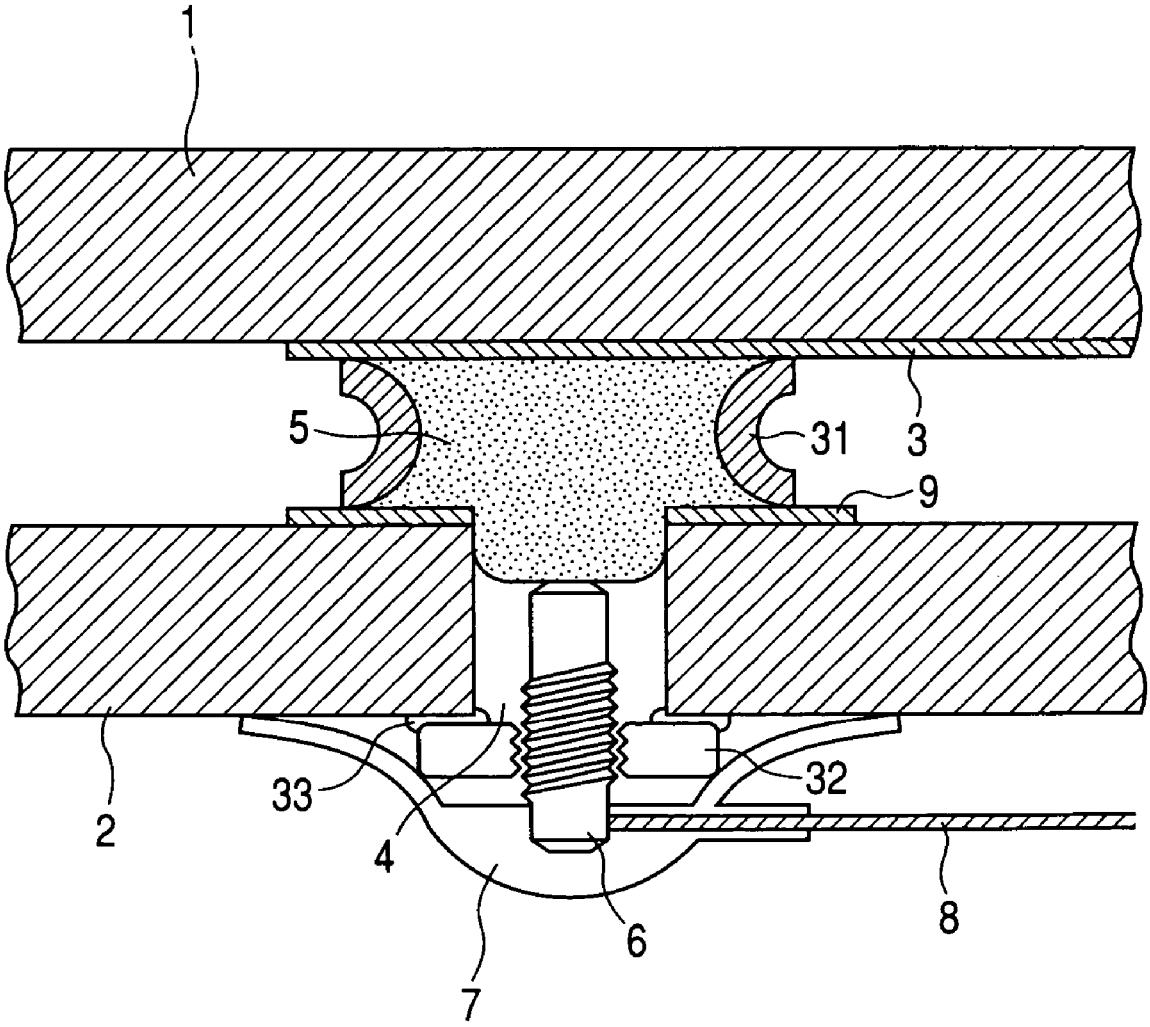
FIG. 3 is a schematic sectional view of another embodiment of the voltage applying structure of the present invention.

In the embodiment shown in FIG. 3, the conduction between the electroconductive part 6 and the voltage supply cable 8 is secured by the caulking structure. Moreover, the conduction between the electroconductive part 6 and the low melting point metal 5 is secured by screwing the electroconductive part 6 into the fixing nut 32 fixed to the second substrate 2 with the adhesive 33.

Figure 5:
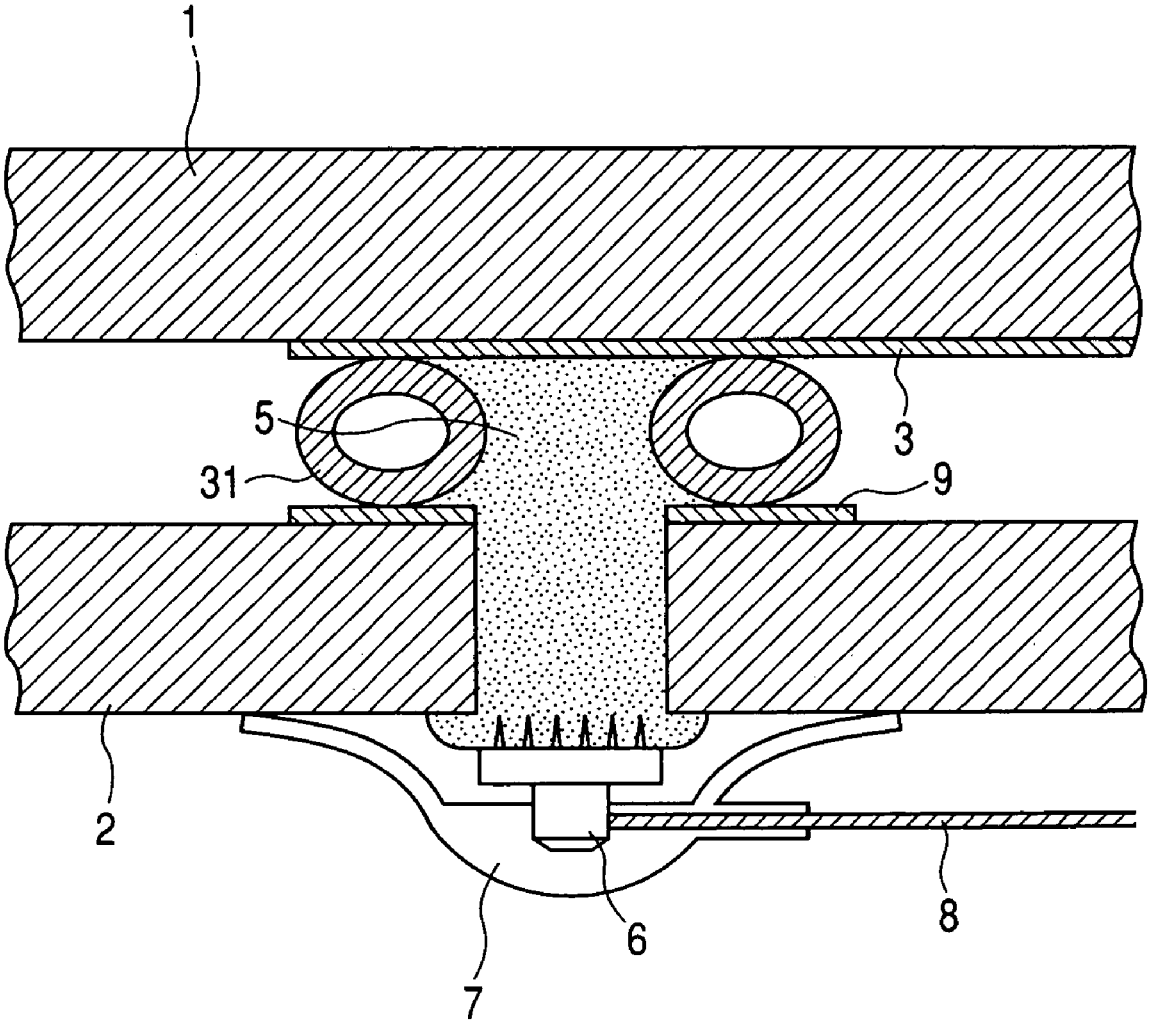
FIG. 5 is a schematic sectional view of a further embodiment of the voltage applying structure of the present invention.

In the embodiment of FIG. 5, the conduction between the electroconductive part 6 and the voltage supply cable 8 is secured by soldering. Moreover, the conduction between the electroconductive part 6 and the low melting point metal 5 is secured by inserting the needle portion of the electroconductive part 6 equipped with the needle portion into the low melting point metal 5.

Figure 7:
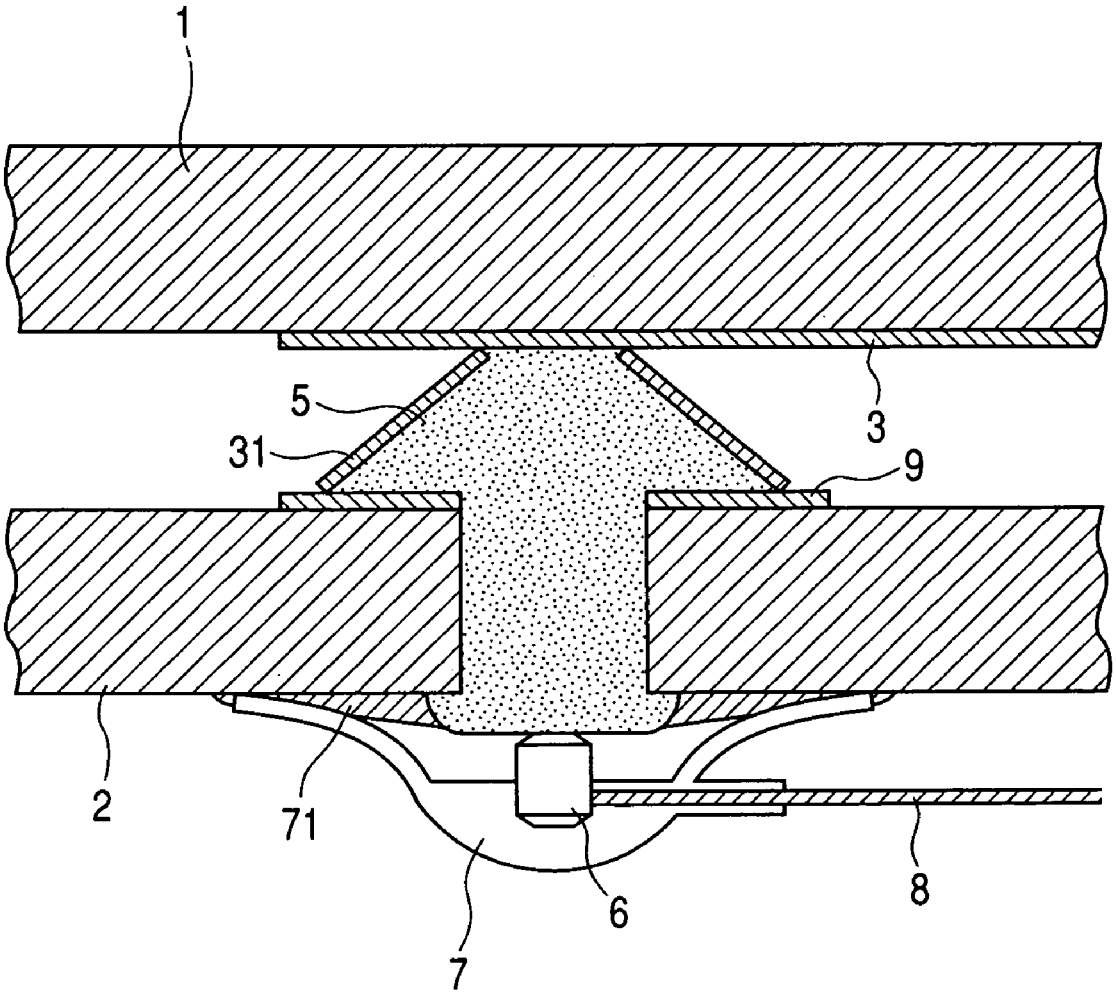
FIG. 7 is a schematic sectional view of a still further embodiment of the voltage applying structure of the present invention.

In the embodiment of FIG. 7, the conduction between the electroconductive part 6 and the voltage supply cable 8 is secured by soldering. Moreover, the conduction between the electroconductive part 6 and the low melting point metal 5 is secured by making the insulating cover 7 adhere to the second substrate 2 with the potting agent 71.

Figure 9:
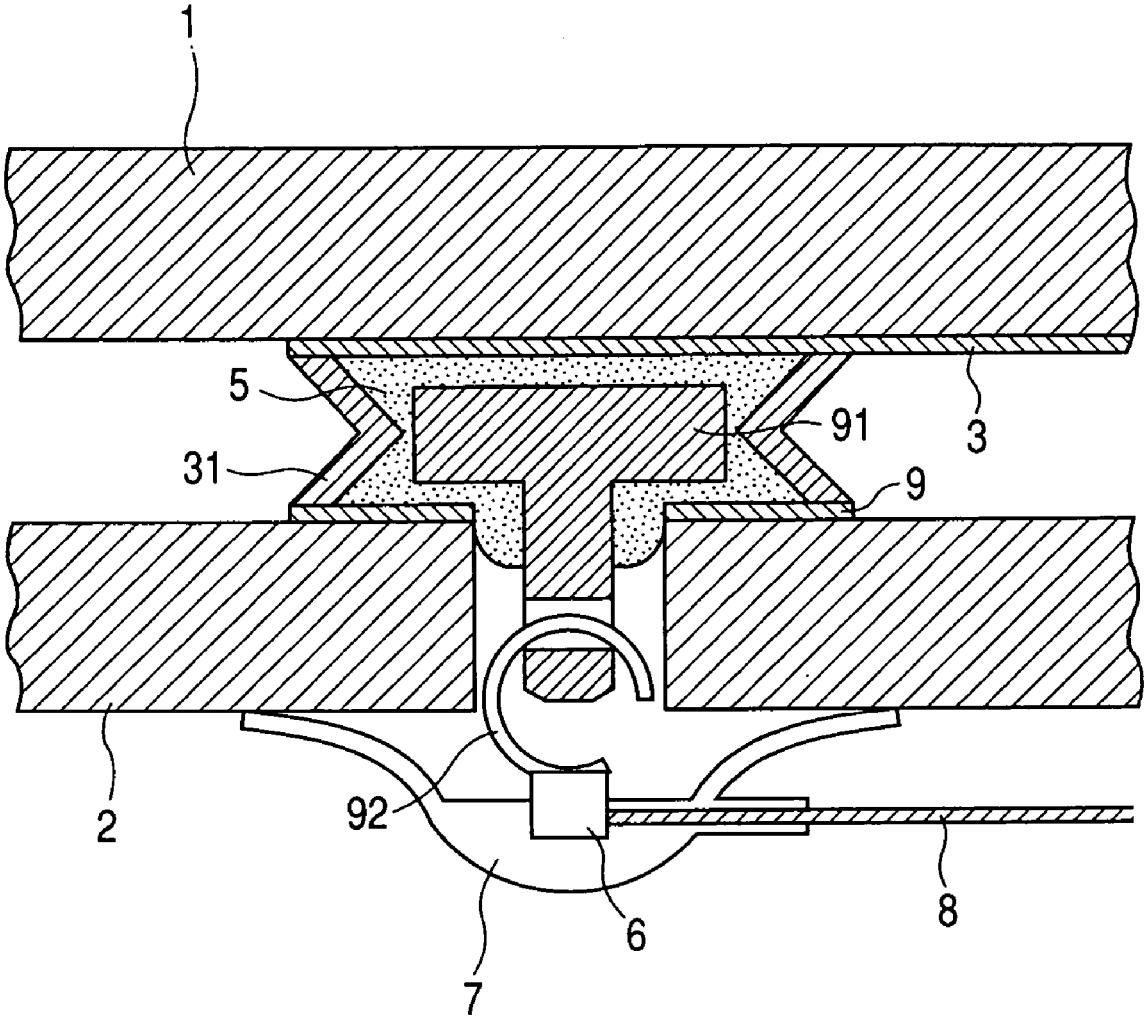
FIG. 9 is a schematic sectional view showing a still further embodiment of the voltage applying structure of the present invention.

In the embodiment of FIG. 9, the conduction between the electroconductive part 6 and the voltage supply cable 8 is secured by the caulking structure. The conduction between the electroconductive part 6 and the low melting point metal 5 is secured by hanging the hook 92 of the electroconductive part 6 equipped with the hook 92 in the hole of the metal part 91 embedded in the low melting point metal 5.

Moreover, FIGS. 4A, 4B, 4C, 4D, 6A, 6B, 6C, 6D, 8A, 8B, 8C, 8D, 10A, 10B, 10C and 10D are the process drawings of manufacturing the embodiments of FIGS. 3, 5, 7 and 9, respectively.

In the present invention, as shown in FIGS. 4A, 4B, 4C, 4D, 6A, 6B, 6C, 6D, 8A, 8B, 8C, 8D, 10A, 10B, 10C and 10D, by using members produced by inpouring the low melting point metals 5 into the control members 31 beforehand, the low melting point metals 5 as the electroconductive members are enclosed by the control members 31, and it is prevented for the low melting point metals 5 to flow out to the neighborhood owing to the inclination of the second substrates 2 when the low melting point metals 5 are melted by the heads for energization heating 10. Then, the voltage applying holes 4 can be sealed in a good condition. Here, the control members 3 are members having melting points higher than those of the low melting point metals 5 as the electroconductive members. Moreover, by giving the elastic functions to the control members 31, the control members 31 bend suitably when the first substrates 1 are made to descend, and it can be prevented that the low melting point metals 5 flow out to the outside. As the control members 31, one having the section of a semicircle as shown in FIG. 3, one having the section of a circle as shown in FIG. 5, one having the section of a straight line as shown in FIG. 7, one having the section of a bent straight line as shown in FIG. 9, and the like can be suitably used. Moreover, as the materials of the control members 31, metals and carbon can be used.

As described above, in the voltage applying path according to the present invention, the seal-bonding temperature can be lowered while the hermetic reliability is being kept. Then, the image display apparatus can be produced at a lower price. Moreover, the image display apparatus can be produced without any problems on the environmental health.

EXAMPLES

Example 1

A voltage applying path having the form shown in FIG. 1 was produced in accordance with the process of FIGS. 2A, 2B, 2C and 2D.

Before pasting the first substrate 1 and the second substrate 2 to each other, the positive electrode wire 3 and the under electrode 9 were printed on the first substrate 1 and the second substrate 2, respectively, with Ag paste. The first and the second substrates 1 and 2 were calcinated at 530° C. in a batch type furnace to form the positive electrode 3 and the under electrode 9. Subsequently, an outer frame, the first substrate 1 and the second substrate 2 were pasted together to form a container.

The container was disposed in the vacuum atmosphere at $1\times10^{-6}$ Pa or less, and In alloy was disposed as the low melting point metal 5 in order to cover the voltage applying hole 4 in the second substrate 2 (FIG. 2A). A positioning projecting portion was previously formed on the low meting point metal 5 in order to make it easy to mount the low melting point metal 5 on the second substrate 2, and the projecting portion was set to be fitted in the voltage applying hole 4.

Next, the head for energization heating 10 was inserted into the voltage applying hole 4 from the opposite side thereof, and was contacted to the low melting point metal 5. Then, current was flown to melt the low melting point metal 5 (FIG. 2B). At this time, since the melting point of the In alloy was 158° C., the temperature was maintained after having been raised up to about 200° C.

When the low melting point metal 5 had been completely melted, the first substrate 1, on which the positive electrode wire 3 was formed, descended to make the low melting point metal 5 and the positive electrode wire 3 be contacted with each other, and they were held for 10 minutes or more in that state (FIG. 2C).

After that, the head for energization heating 10 was retracted from the voltage applying hole 4, and natural heat dissipation by radiation was performed for 30 minutes. Thereby, the In alloy was solidified, and the voltage applying hole 4 was sealed (FIG. 2D).

Moreover, mounting for the voltage application from the outside was performed. First, the electroconductive part 6 and the voltage supply cable 8, which are made to adhere to each other by soldering, are inserted and fixed into the insulating cover 7. The electroconductive part 6 was made by the press working of brass, and nickel base gilding was performed on the surface of the brass. The gilding is for improving the reliability of soldering with the voltage supply cable 8. Then, the insulating cover 7 was fixed in the state in which the low melting point metal 5 was contacted with the electroconductive part 6. As the fixing means, the pressing force from the back surface of the insulating cover 7 was used. The insulating cover 7 has the principal component of silicone rubber, and was installed so that the insulating cover 7 may adhere closely to the second substrate 2.

By configuring the voltage applying path as described above, an image display apparatus could be produced at a low seal-bonding temperature while securing hermetic reliability.

Example 2

A voltage applying path of the form shown in FIG. 3 was produced in accordance with the process of FIGS. 4A, 4B, 4C and 4D.

First, a member produced by inpouring melted Sn alloy as the low melting point metal 5 into the control member 31 made of stainless to solidify therein was previously prepared. Incidentally, a projecting portion to be fitted to the voltage applying hole 4 was formed on the low melting point metal 5.

Figure 4A:
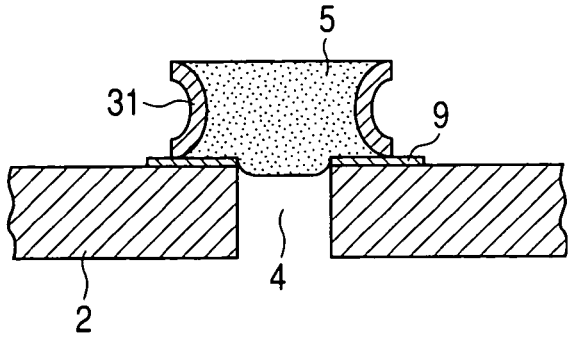
FIGS. 4A, 4B, 4C and 4D are process drawings of manufacturing the voltage applying structure of FIG. 3.

Like Example 1, a container formed by pasting the first substrate 1 and the second substrate 2 together with each other was disposed in an vacuum atmosphere of $1\times10^{-6}$ Pa or less, and the low melting point metal 5 solidified in the control member 31 was disposed in order that the projecting portion thereof should be fit into the voltage applying hole 4 (FIG. 4A).

Figure 4B:
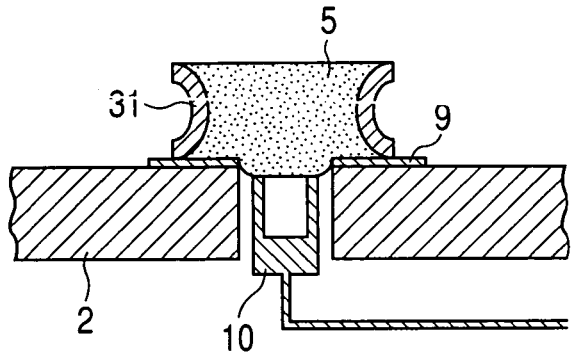

The head for energization heating 10 was inserted into the voltage applying hole 4 from the opposite side to the one covered by the low melting point metal 5 to be contacted with the low melting point metal 5. Then, a current was flown to melt the low melting point metal 5 (FIG. 4B). At this time, since the melting point of Sn alloy was 232° C., the temperature of the Sn alloy was maintained after raising the temperature up to about 280° C.

Figure 4C:
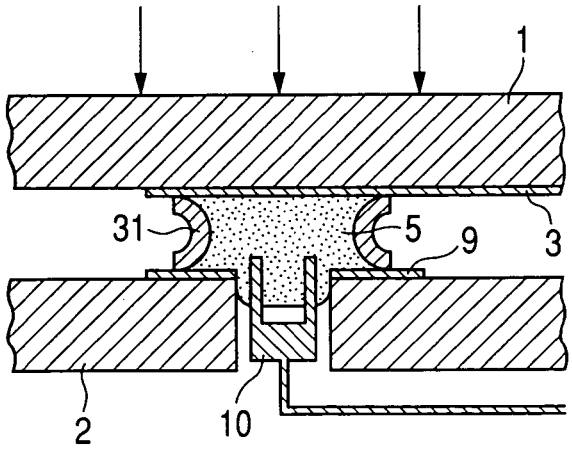

When the low melting point metal 5 had completely melted, the first substrate 1, on which the positive electrode wire 3 was formed, was made to descend, and the low melting point metal 5 and the positive electrode wire 3 were contacted to each other. Then, a pressure was applied to the first substrate 1 from the outside thereof to bend the control member 31 (FIG. 4C). The control member 31 was held in that state for 10 minutes or longer.

Figure 4D:
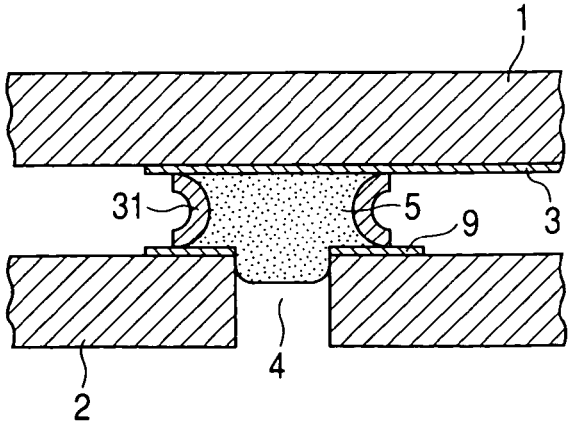

The head for energization heating 10 was retracted from the voltage applying hole 4, and natural heat dissipation by radiation was performed for 30 minutes. Thereby, Sn alloy was solidified, and the voltage applying hole 4 was sealed (FIG. 4D). At this time, by arranging the control member 31 around the low melting point metal 5, it could be prevented that the low melting point metal 5 flowed out owing to the inclination of the second substrate 2 when the low melting point metal 5 melted. Moreover, by giving an elastic function to the control member 31, it was able to prevent that the melted low melting point metal 5 overflowed from the control member 31.

Moreover, mounting for the voltage application from the outside was performed. First, the electroconductive part 6 and the voltage supply cable 8 which were made to adhere with each other by soldering were inserted and fixed into the insulating cover 7. The electroconductive part 6 was produced by performing the press working of brass, and nickel base gilding was performed on the surface of the brass. The gilding is for improving the reliability of the soldering with the voltage supply cable 8. First, the fixing nut 32 was made to adhere to the substrate 2 with the epoxy adhesive 33 to be fixed thereto, and the thread portion of the electroconductive part 6 was inserted into the internal thread portion of the fixing nut 32 to be rotated therein. Then, the screw was tightened until the screw touched at the low melting point metal 5. The insulating cover 7 has the principal component of silicone rubber, and was installed so that the insulating cover 7 might adhere closely to the second substrate 2.

By configuring the voltage applying path as described above, an image display apparatus could be produced at a low seal-bonding temperature while securing hermetic reliability. Moreover, in the present example, the accuracy of controlling the shape of the low melting point metal 5 was improved by means of the control member 31, and it became possible to apply a voltage stably.

Example 3

A voltage applying path of the form shown in FIG. 5 was produced in accordance with the process of FIGS. 6A, 6B, 6C and 6D.

First, a member produced by inpouring melted Bi alloy as the low melting point metal 5 into the control member 31 made of carbon to solidify therein was previously prepared. Incidentally, a projecting portion to be fitted to the voltage applying hole 4 was formed on the low melting point metal 5.

Figure 6A:
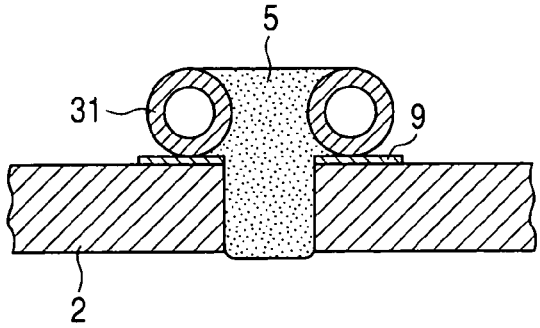
FIGS. 6A, 6B, 6C and 6D are process drawings of manufacturing the voltage applying structure of FIG. 5.

Like Example 1, a container formed by pasting the first substrate 1 and the second substrate 2 together with each other was disposed in an vacuum atmosphere of $1\times10^{-6}$ Pa or less, and the low melting point metal 5 solidified in the control member 31 was disposed in order that the projecting portion thereof should be fit into the voltage applying hole 4 (FIG. 6A).

Figure 6B:
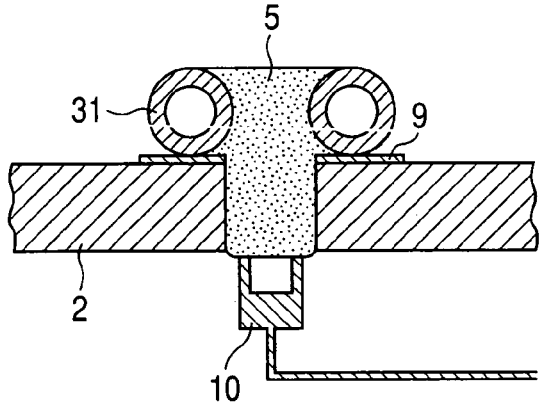

The head for energization heating 10 was inserted into the voltage applying hole 4 from the opposite side to the one covered by the low melting point metal 5 to be contacted with the low melting point metal 5. Then, a current was flown to melt the low melting point metal 5 (FIG. 6B). At this time, since the melting point of Bi alloy was 271° C., the temperature of the Bi alloy was maintained after raising the temperature up to about 300° C.

Figure 6C:
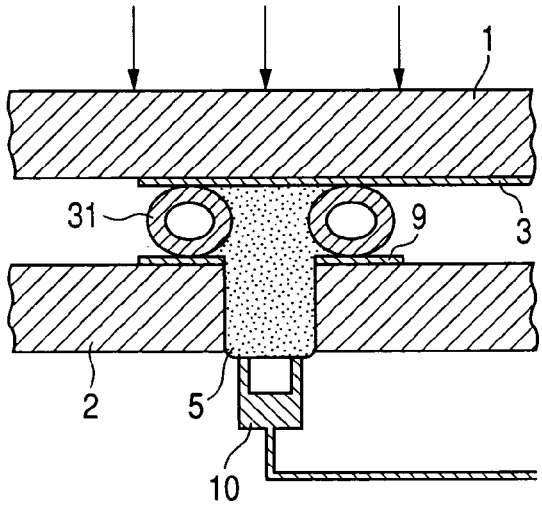

When the low melting point metal 5 had completely melted, the first substrate 1, on which the positive electrode wire 3 was formed, was made to descend, and the low melting point metal 5 and the positive electrode wire 3 were contacted to each other. Then, a pressure was applied to the first substrate 1 from the outside thereof to bend the control member 31 (FIG. 6C). The control member 31 was held in that state for 10 minutes or longer.

Figure 6D:
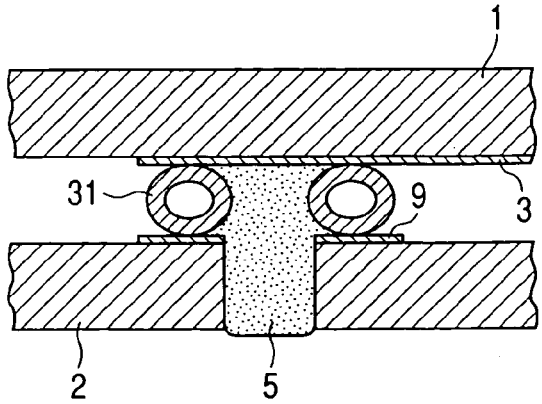

The head for energization heating 10 was retracted from the voltage applying hole 4, and natural heat dissipation by radiation was performed for 30 minutes. Thereby, Bi alloy was solidified, and the voltage applying hole 4 was sealed (FIG. 6D). At this time, by arranging the control member 31 around the low melting point metal 5, it could be prevented that the low melting point metal 5 flowed out owing to the inclination of the second substrate 2 when the low melting point metal 5 melted. Moreover, by giving an elastic function to the control member 31, it was able to prevent that the melted low melting point metal 5 overflowed from the control member 31.

Moreover, mounting for the voltage application from the outside was performed. First, the electroconductive part 6 and the voltage supply cable 8 which were made to adhere with each other by soldering were inserted and fixed into the insulating cover 7. The electroconductive part 6 was produced by performing the press working of brass, and nickel base gilding was performed on the surface of the brass. The gilding is for improving the reliability of the soldering with the voltage supply cable 8. Then, the contact and the conduction were secured by inserting the needle portion of the electroconductive part 6 into the melting point metal 5. The insulating cover 7 has the principal component of silicone rubber, and was installed so that the insulating cover 7 might adhere closely to the second substrate 2. By disposing the low melting point metal 5 to be embedded in the voltage applying hole 4 of the second substrate 2, the conduction structure with the electroconductive part 6 became easy.

By configuring the voltage applying path as described above, an image display apparatus could be produced at a low seal-bonding temperature while securing hermetic reliability. Moreover, in the present example, the accuracy of controlling the shape of the low melting point metal 5 was improved by means of the control member 31, and it became possible to apply a voltage stably.

Example 4

A voltage applying path of the form shown in FIG. 7 was produced in accordance with the process of FIGS. 8A, 8B, 8C, and 8D.

First, a member produced by inpouring melted In alloy as the low melting point metal 5 into the control member 31 shaped by press working of SUS 304 to solidify therein was previously prepared. Incidentally, a projecting portion to be fitted to the voltage applying hole 4 was formed on the low melting point metal 5.

Figure 8A:
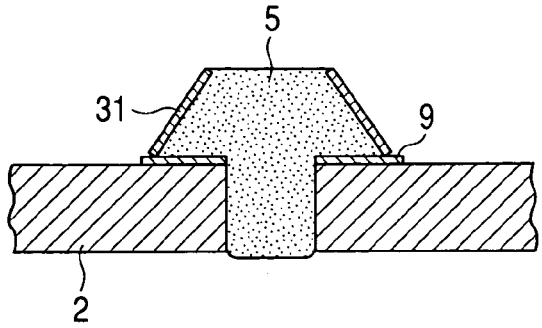
FIGS. 8A, 8B, 8C and 8D are process drawings for manufacturing the voltage applying structure of FIG. 7.

Like Example 1, a container formed by pasting the first substrate 1 and the second substrate 2 together with each other was disposed in an vacuum atmosphere of $1\times10^{-6}$ Pa or less, and the low melting point metal 5 solidified in the control member 31 was disposed in order that the projecting portion thereof should be fit into the voltage applying hole 4 (FIG. 8A).

Figure 8B:
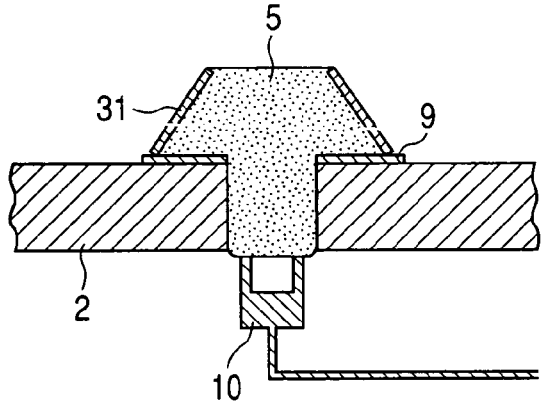

The head for energization heating 10 was inserted into the voltage applying hole 4 from the opposite side to the one covered by the low melting point metal 5 to be contacted with the low melting point metal 5. Then, a current was flown to melt the low melting point metal 5 (FIG. 8B). At this time, since the melting point of In alloy was 156° C., the temperature of the In alloy was maintained after raising the temperature up to about 180° C.

Figure 8C:
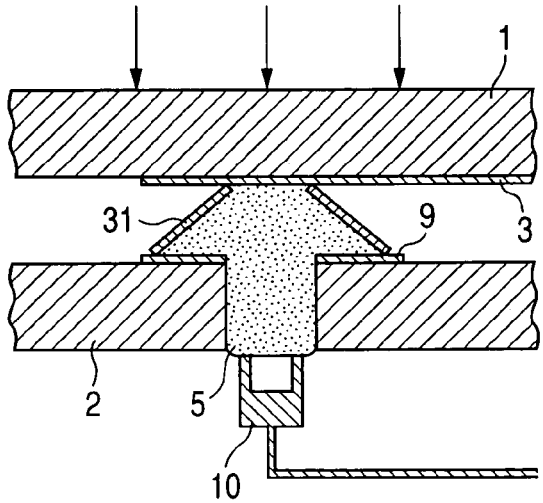

When the low melting point metal 5 had completely melted, the first substrate 1, on which the positive electrode wire 3 was formed, was made to descend, and the low melting point metal 5 and the positive electrode wire 3 were contacted to each other. Then, a pressure was applied to the first substrate 1 from the outside thereof to bend the control member 31 (FIG. 8C). The control member 31 was held in that state for 10 minutes or longer.

Figure 8D:
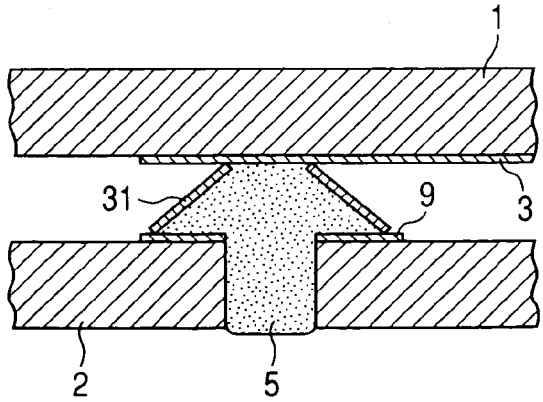

The head for energization heating 10 was retracted from the voltage applying hole 4, and natural heat dissipation by radiation was performed for 30 minutes. Thereby, In alloy was solidified, and the voltage applying hole 4 was sealed (FIG. 8D). At this time, by arranging the control member 31 around the low melting point metal 5, it could be prevented that the low melting point metal 5 flowed out owing to the inclination of the second substrate 2 when the low melting point metal 5 melted. Moreover, by giving an elastic function to the control member 31, it was able to prevent that the melted low melting point metal 5 overflowed from the control member 31.

Moreover, mounting for the voltage application from the outside was performed. First, the electroconductive part 6 and the voltage supply cable 8 which were made to adhere with each other by soldering were inserted and fixed into the insulating cover 7. The electroconductive part 6 was produced by performing the press working of brass, and nickel base gilding was performed on the surface of the brass. The gilding is for improving the reliability of the soldering with the voltage supply cable 8. Then, the potting agent 71 was coated on the side of the second substrate 2 opposite to the first substrate 1 in the neighborhood of the low melting point metal 5 with a dispenser, and the potting agent 71 was solidified in the state in which the electroconductive part 6 was contacted and conducted to the low melting point metal 5. The potting agent 71 was one-liquid type silicone, and one of the type of absorbing the moisture in the air to be solidified was used. The insulating cover 7 has the principal component of silicone rubber, and was installed so that the insulating cover 7 might adhere closely to the second substrate 2. By disposing the low melting point metal 5 to be embedded in the voltage applying hole 4 of the second substrate 2, the conduction structure with the electroconductive part 6 became easy.

By configuring the voltage applying path as described above, an image display apparatus could be produced at a low seal-bonding temperature while securing hermetic reliability. Moreover, in the present example, the accuracy of controlling the shape of the low melting point metal 5 was improved by means of the control member 31, and it became possible to apply a voltage stably.

Moreover, by using the potting agent 71, the ingress of an alien substance into the insulating cover 7 could be prevented, and a stable voltage supply and a stable image display could be obtained.

Example 5

A voltage applying path of the form shown in FIG. 9 was produced in accordance with the process of FIGS. 10A, 10B, 10C, and 10D.

First, a member produced by inpouring melted Sn alloy as the low melting point metal 5 into the control member 31 made of copper alloy, in which a metal part 91 made of copper alloy was put, to solidify therein was previously prepared. Incidentally, a projecting portion to be fitted to the voltage applying hole 4 was formed on the low melting point metal 5.

Figure 10A:
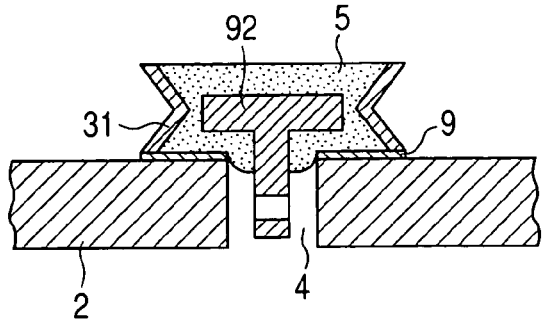
FIGS. 10A, 10B, 10C and 10D are process drawings of manufacturing the voltage applying structure of FIG. 9.

Like Example 1, a container formed by pasting the first substrate 1 and the second substrate 2 together with each other was disposed in an vacuum atmosphere of $1\times10^{-6}$ Pa or less, and the low melting point metal 5 solidified in the control member 31 was disposed in order that the projecting portion thereof should be fit into the voltage applying hole 4 (FIG. 10A).

Figure 10B:
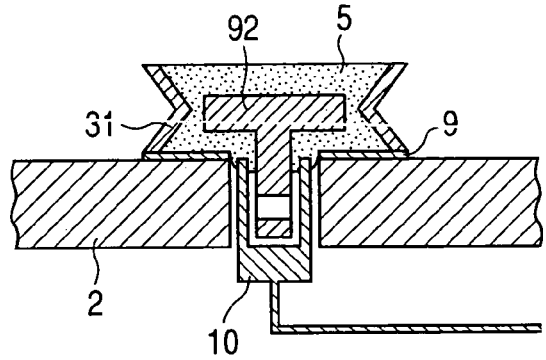

The head for energization heating 10 was inserted into the voltage applying hole 4 from the opposite side to the one covered by the low melting point metal 5 to be contacted with the low melting point metal 5. Then, a current was flown to melt the low melting point metal 5 (FIG. 10B). At this time, since the melting point of Sn alloy was 232° C., the temperature of the Sn alloy was maintained after raising the temperature up to about 280° C.

Figure 10C:
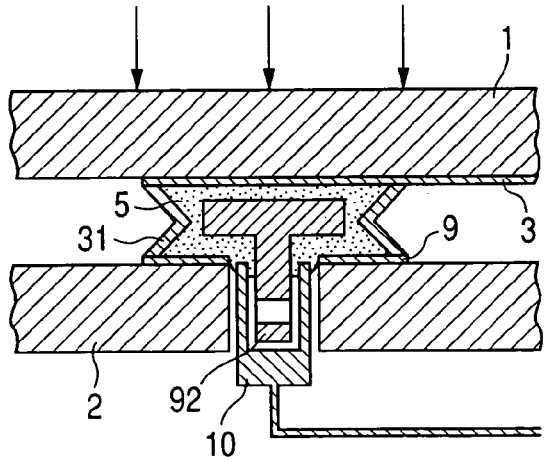

When the low melting point metal 5 had completely melted, the first substrate 1, on which the positive electrode wire 3 was formed, was made to descend, and the low melting point metal 5 and the positive electrode wire 3 were contacted to each other. Then, a pressure was applied to the first substrate 1 from the outside thereof to bend the control member 31 (FIG. 10C). The control member 31 was held in that state for 10 minutes or longer.

Figure 10D:
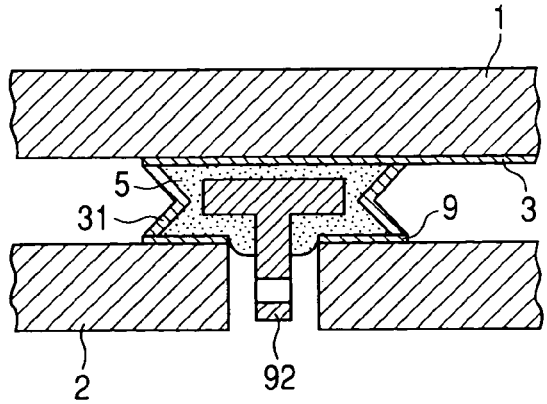
Figure 11:
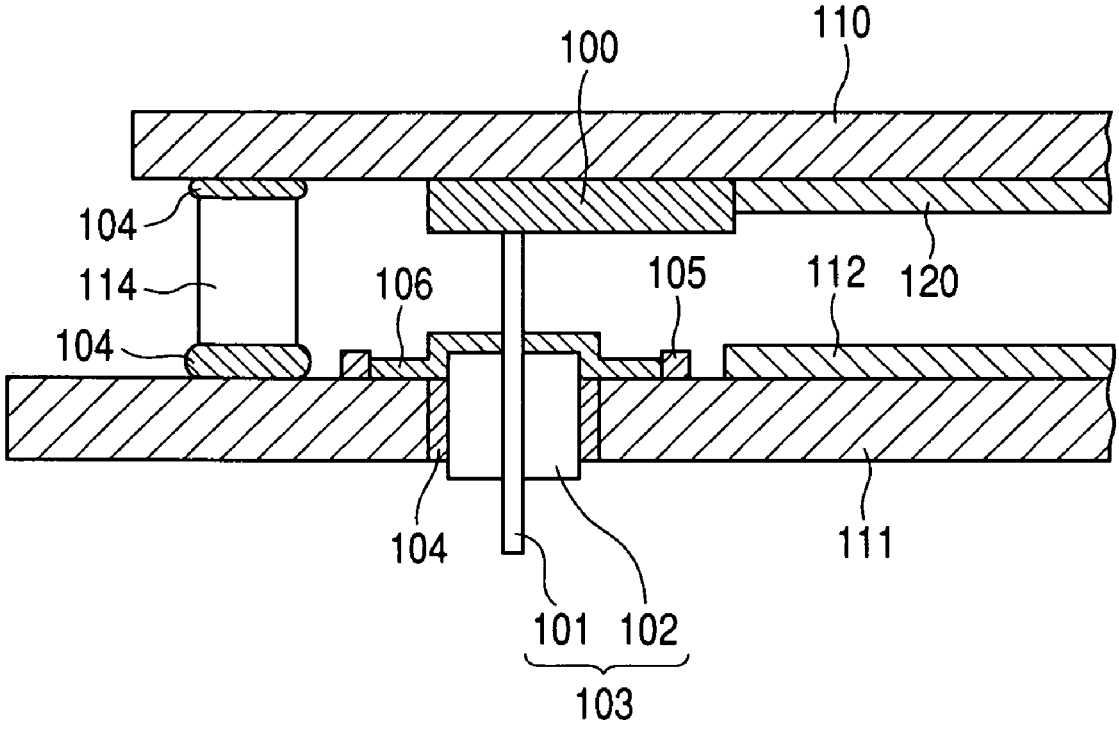
FIG. 11 is a schematic sectional view of a conventional voltage applying structure.

The head for energization heating 10 was retracted from the voltage applying hole 4, and natural heat dissipation by radiation was performed for 30 minutes. Thereby, Sn alloy was solidified, and the voltage applying hole 4 was sealed (FIG. 10D). At this time, by arranging the control member 31 around the low melting point metal 5, it could be prevented that the low melting point metal 5 flowed out owing to the inclination of the second substrate 2 when the low melting point metal 5 melted. Moreover, by giving an elastic function to the control member 31, it was able to prevent that the melted low melting point metal 5 overflowed from the control member 31.

Moreover, mounting for the voltage application from the outside was performed. First, the electroconductive part 6 and the voltage supply cable 8 which were made to adhere with each other by soldering were inserted and fixed into the insulating cover 7. The electroconductive part 6 was produced by performing the press working of brass, and nickel base gilding was performed on the surface of the brass. The hook 92 was made of SUS 304. The gilding is for improving the reliability of the soldering with the voltage supply cable 8. Then, the contact and the conduction were secured by inserting the hook 92 into the hole of the metal part 91. The insulating cover 7 has the principal component of silicone rubber. Since the flange portion of the insulating cover 7 was adapted to expand by a reaction force when the hook 92 was hung on the metal part 91, the insulating cover 7 could adhere closely to the second substrate 2. Moreover, a tension is always generated at the contacting portion of the hook 92 and the metal part 91.

By configuring the voltage applying path as described above, an image display apparatus could be produced at a low seal-bonding temperature while securing hermetic reliability. Moreover, in the present example, the accuracy of controlling the shape of the low melting point metal 5 was improved by means of the control member 31, and it became possible to apply a voltage stably.

Moreover, by using the metal part 91, the stability of shaping the low melting point metal 5 was increased. Consequently, an image display apparatus including a voltage applying path having a higher reliability could be produced.

This application claims priority from Japanese Patent Application No. 2004-115239 filed Apr. 9, 2004, which is hereby incorporated by reference herein.

What is claimed is:

1. An image display apparatus including a hermetic container, which includes a first substrate having a phosphor and an electrode connected to the phosphor, wherein a high voltage is applied to the electrode, a second substrate disposed opposite to said first substrate and having an electron source for colliding an electron with the phosphor, and an outer frame disposed between both of said substrates, wherein the substrates are seal bonded through the outer frame by an adhesive, and further comprising an electroconductive member of a single member for connecting the electrode with the second substrate, the electroconductive member adheres to the electrode, forms a path for applying a voltage to the electrode, and adheres to the second substrate to seal a hole formed in the second substrate so as to seal the hermetic container.

2. An image display apparatus according to claim 1, further comprising a member enclosing said electroconductive member at a gap between said first substrate and said second substrate, said member having a melting point higher than that of said electroconductive member.

3. An image display apparatus according to claim 1, wherein said electroconductive member is a metal having a melting point of 350° C. or less.

4. An image display apparatus according to claim 3, wherein said electroconductive member is an alloy containing at least one selected from the group consisting of In, Li, Bi and Sn.

5. An image display apparatus according to claim 1, wherein said electrode is one for accelerating electrons emitted from said electron source.

6. A manufacturing method of an image display apparatus equipped with a hermetic container, which includes a first substrate having a phosphor and an electrode connected to the phosphor, wherein a high voltage is applied to the electrode, a second substrate disposed opposite to said first substrate and having an electron source for colliding an electron with the phosphor, and an outer frame disposed between both of said substrates, wherein the substrates are seal bonded through the outer frame by an adhesive, comprising the steps of:

disposing a sealing member of a single member formed from an electroconductive member on said second substrate including a hole formed therein in order to cover the hole;

disposing said first substrate provided with said electrode so that said electrode and said sealing member may be opposed to each other; and heating said sealing member to perform adhesion of said sealing member to said electrode and perform adhesion of said sealing member to said second substrate to seal the hermetic container.

7. A manufacturing method of an image display apparatus according to claim 6, wherein said sealing member disposed on said second substrate includes a member around said sealing member, said member having a melting point higher than that of said sealing member.

8. A manufacturing method of an image display apparatus according to claim 6, wherein said sealing member is metal having a melting point of 350° C. or less.

9. A manufacturing method of an image display apparatus according to claim 8, wherein said electroconductive member is an alloy containing at least one selected from the group consisting of In, Li, Bi and Sn.

10. A manufacturing method of an image display apparatus according to claim 6, wherein said image display apparatus further includes an electron source disposed on said second substrate, and a phosphor disposed on said first substrate in said hermetic container, and said electrode is one for accelerating electrons emitted from said electron source.

11. An image display apparatus according to claim 1, further comprising a member having elasticity for surrounding the electroconductive member in a gap between the first and second substrates.

* * * * *